United States Patent [19]

Grohn

[11] Patent Number: 4,461,150

[45] Date of Patent: Jul. 24, 1984

[54] EXHAUST GAS RETURN PIPE CONNECTION FOR AN INTERNAL COMBUSTION ENGINE

[75] Inventor: Michael Grohn, Esslingen, Fed. Rep. of Germany

[73] Assignee: Daimler-Benz Aktiengesellschaft, Stuttgart, Fed. Rep. of Germany

[21] Appl. No.: 350,872

[22] Filed: Feb. 22, 1982

[30] Foreign Application Priority Data

Feb. 21, 1981 [DE] Fed. Rep. of Germany ..... 3106588

[51] Int. Cl.[3] ..... F02B 37/00; F02M 25/06

[52] U.S. Cl. ..... 60/605; 123/568

[58] Field of Search ..... 60/605; 123/568, 569

[56] References Cited

U.S. PATENT DOCUMENTS

| | | | |
|---|---|---|---|
| 2,720,196 | 10/1955 | Wolf | 123/568 |
| 3,116,725 | 1/1964 | Hadley | 123/568 |
| 3,416,503 | 12/1968 | High | 123/568 |
| 4,206,606 | 1/1980 | Yamada | 60/605 |

FOREIGN PATENT DOCUMENTS 2343337 3/1974 Fed. Rep. of Germany .

*Primary Examiner*—Michael Koczo
*Assistant Examiner*—Peggy A. Neils
*Attorney, Agent, or Firm*—Craig & Burns

[57] ABSTRACT

A connection for an exhaust gas return pipe which includes a duct spirally disposed around an intake pipe of an internal combustion engine. Exhaust gases flow through the duct and enter, from the spiral duct, through overflow openings into the intake pipe so as to enable the exhaust gases to be intensively mixed with the intake air.

6 Claims, 3 Drawing Figures

EXHAUST GAS RETURN PIPE CONNECTION FOR AN INTERNAL COMBUSTION ENGINE

The present invention relates to a connection arrangement and, more particularly, to a connection for an exhaust gas return pipe to the intake pipe of an internal combustion engine.

In an attempt to reduce the content of nitrogen-oxides in the exhaust gas of internal combustion engines, the external exhaust gas return is generally employed, especially with diesel internal combustion engines. Usually, a connection is established between the exhaust system and the intake system of the internal combustion engine by means of an exhaust gas return line containing an exhaust gas return valve. With such an arrangement, the returned exhaust gas is mixed with intake air prior to introduction into a combustion chamber of the internal combustion engine. This mixing of exhaust gas and fresh air is relatively non-homogeneous because, as described, for example in German Pat. No. 2,343,337, the exhaust gas return line terminates with full cross section laterally in the intake pipe of the intake system of the engine.

The aim underlying the present invention essentially resides in providing an exhaust gas return system which ensures a mixture formation of intake air and exhaust gas that is as homogeneous as possible and thereby ensures an even distribution of the exhaust gas components to the individual cylinders of the engine.

The underlying problems are solved in accordance with the present invention in that the connection of the exhaust gas return line with the suction line is formed by a spiral duct which extends about the intake pipe in a housing and by a plurality of overflow openings provided in the area of the spiral duct.

Due to the spiral duct inclined overflow openings, an even supply of exhaust gases is achieved over the entire circumference of the intake line. Moreover, the flow of exhaust gases entering the intake line receives a distinctive swirl or movement in a circumferential direction so that an intensive whirl of the mixture is created with the intake air. Because of the higher temperatures, the exhaust gas components have a lower density than the intake air and, consequently, the exhaust gas components flow in the direction toward the center of the intake duct and mix with the intake air so that a homegenous mixture is produced.

In accordance with further advantageous features of the present invention, the housing of the spiral duct may be formed by the intake line itself. The intake pipe or line can thereby be split or divided in the area of the spiral duct in such a manner that the inclined overflow openings and a cover that closes the duct in one of the axial directions are components of one part of the intake pipe, and the circumferential wall and bottom of the duct are a component of the other part of the intake pipe.

With internal combustion engines having exhaust driven superchargers, the mixing of the intake air and the exhaust gas may still be aided further by constructing the spiral duct in such a manner that the direction of rotation of the exhaust gas flow corresponds to that of the intake air coming from the compressor of the exhaust driven supercharger. The rotation of the intake air coming from the compressor may thereby be realized by any conventional means, for example, by the use of a radial compressor of a turbocharger.

Accordingly, it is an object of the present invention to provide a connection for an exhaust gas return system which avoids, by simple means, the shortcomings and disadvantages encountered in the prior art.

Another object of the present invention resides in providing a connection for an exhaust gas return system which ensures an even distribution of exhaust gas components to individual cylinders of an internal combustion engine.

Yet another object of the present invention resides in providing a connection for an exhaust gas return system which enables an increase in the quantities of returned exhaust gases.

A further object of the present invention resides in providing a connection for an exhaust gas return system which is simple in construction and therefore relatively inexpensive to manufacture.

A still further object of the present invention resides in providing a connection for an exhaust gas return system which ensures the supply of a homeogeneous mixture of exhaust gas and intake air into an intake system of an internal combustion engine.

Yet another object of the present invention resides in providing a connection for an exhaust gas return system which ensures an efficient operation of an internal combustion engine under all operating loads of the engine.

These and other objects, features, and advantages of the present invention will become more apparent from the following description when taken in connection with the accompanying drawing which shows, for the purposes of illustration only, one embodiment in accordance with the present invention, and wherein.

Figure 1:
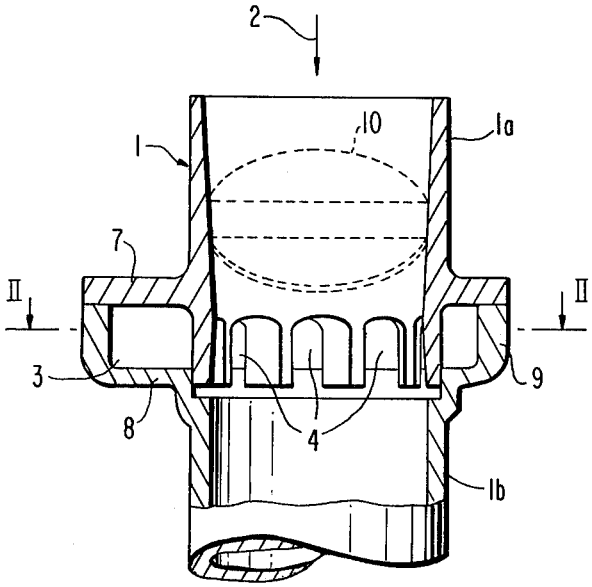
FIG. 1 is a longitudinal cross sectional view of a connection of an air intake pipe and exhaust gas return pipe constructed in accordance with the present invention.
Figure 2:
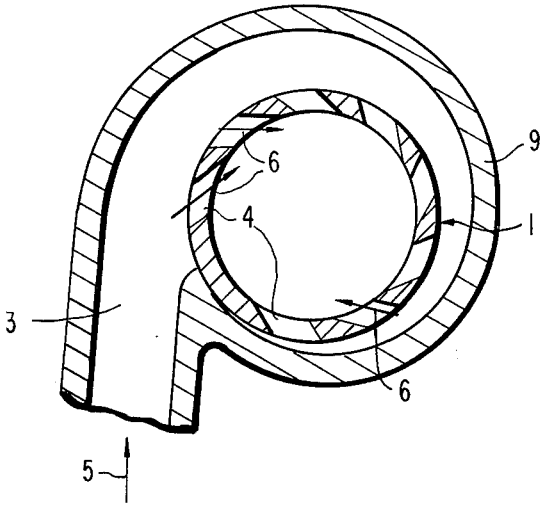
FIG. 2 is a cross sectional view taken along the line II—II in FIG. 1.

Referring now to the drawing wherein like reference numerals are used in the various views thereof, to designate like parts and, more particularly, to FIGS. 1 and 2, a duct 3, connected with an exhaust gas return pipe (not shown) is connected to an intake pipe or line generally designated by reference numeral 1 leading to the inlet of an internal combustion engine; the fresh air flows through the intake line 1 in the direction of arrow 2 (FIG. 1). The duct 3 has a spiral configuration and is disposed around the intake pipe 1. A plurality of overflow openings 4, distributed about the circumference of the intake pipe 1 and inclined at an angle to the radial direction of the inlet pipe 1, establish a connection from the duct 3 to the interior of the intake pipe 1.

As shown most clearly in FIG. 2, the plurality of overflow openings 4 are equally spaced around the intake pipe 1; the openings 4 are so disposed that their axes, when projected, are tangential to an imaginary circle concentric with, but smaller in diameter than, the intake pipe. Therefore, exhaust gas that flows in a direction of the arrow 5 (FIG. 2) into the spiral duct 3, reaches the intake line 1 in the direction indicated by the arrow 6.

As shown in FIG. 1, the intake pipe 1 consists of two parts 1*a*, 1*b*; the upper part 1*a* is provided with the overflow openings 4 and with a flange-like cover 7 for the spiral duct 3. The lower part 1*b* of the intake pipe 1 forms flange-like the bottom 8 and the circumferential wall 9 of the duct 3 adjoining the bottom 8.

Figure 3:
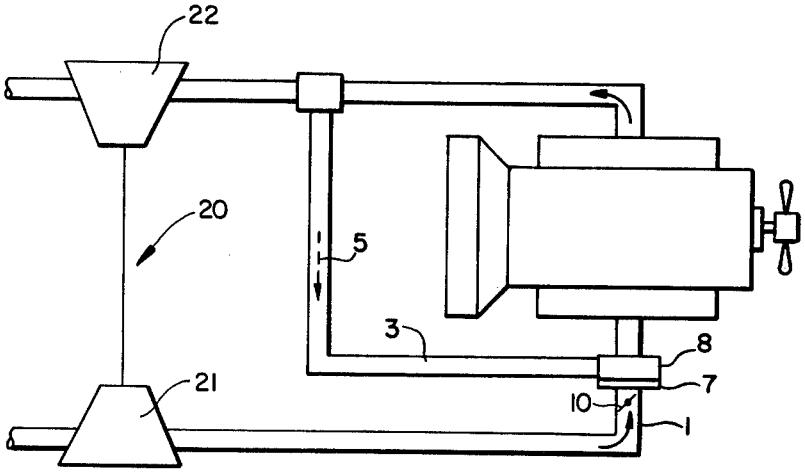
FIG. 3 is a schematic view showing a supercharged diesel internal combustion engine with an air intake and exhaust gas return system in accordance with the present invention.

The connection of the exhaust gas return pipe with the spiral duct 3 at the intake pipe 1 is advantageously arranged in such a manner that a sufficiently long mixing path exists between the connection and an air distributing device of known construction (not shown). As shown in FIG. 3, with an internal combustion engine equipped with an exhaust driven turbocharger generally designated by reference numeral 20 which includes an exhaust gas turbine 22 driving a radial compressor 21, the air supplied by the compressor 21 of the exhaust gas turbocharger 20 moves along a spiral path within the intake pipe 1 with a certain direction of rotation. The spiral configuration of the duct 3 should thereby be disposed about the intake line 1 in such a manner that the direction of rotation or swirl of the exhaust gases flowing from the duct 3 into the intake pipe 1, is in the same direction of rotation as the charging air coming from the compressor 21 of the exhaust driven turbocharger 20. Of course, in lieu of a radial compressor, also other conventional means may be used, known as such to a person skilled in the art, to produce the helical motion of the intake air from the compressor to the internal combustion engine.

In order to increase quantities of exhaust gas to be returned, a throttle valve 10 may be provided in the intake pipe at a position upstream from the connection. The throttle valve 10 enables, with a low charging of the internal combustion engine, an increased throttling of the intake air and thus the supply of a larger amount of exhaust gas. At operating points of the internal combustion engine without an exhaust gas return, the throttle valve is then fully opened.

While I have shown and described only one embodiment in accordance with the present invention, it is understood that the same is not limited thereto but is susceptible of numerous changes and modifications as known to one having ordinary skill in the art and I therefore do not wish to be limited to the details shown and described herein, but intend to cover all such modifications as are encompassed by the scope of the appended claims.

I claim:

1. A connection for an exhaust gas return system of an internal combustion engine, comprising an exhaust gas return pipe means, an intake pipe means, connecting means for connecting the exhaust gas return pipe means with the intake pipe means, the connecting means including a spiral duct means extending spirally about substantially the entire intake pipe means and the intake pipe being provided with a plurality of overflow openings inclined in the radial direction, distributed over the circumference of the intake pipe means and leading into the intake pipe means to establish a communication between the spiral duct means and interior of the intake pipe means to thereby assure a substantially even distribution of the exhaust gases in the air of the intake pipe means.

2. The connection according to claim 1, wherein the intake pipe means includes a first and second part, a first flange means being provided on one of the parts of the intake pipe means for forming an outer wall and a circumferential wall of the duct means, and a second flange means being provided on the other of the parts of the intake pipe means for forming a cover for the duct means.

3. The connection according to claim 1, wherein the plurality of openings are formed in the part of the intake pipe means having the second flange means.

4. The connection according to claim 1, in which the axes of the plurality of inclined overflow openings when projected, are substantially tangential to an imaginary circle concentric with the intake pipe means but of smaller diameter than the intake pipe means.

5. The connection according to either of claims 2 or 1 further comprising an exhaust driven supercharging means including a compressor means delivering intake air along a spiral path within the intake pipe means with a predetermined direction of rotation within said intake pipe means, and the spiral duct means being so arranged that the exhaust gases flow from the exhaust gas pipe means into the intake pipe means by way of said inclined openings with a rotary movement in the same direction of rotation as the air supplied by the compressor means of the supercharging means.

6. The connection according to claim 5, further comprising a throttle valve means arranged in the intake pipe means at a position upstream of the plurality of openings.

* * * * *